US006241558B1

(12) United States Patent
Mosquera

(10) Patent No.: US 6,241,558 B1
(45) Date of Patent: Jun. 5, 2001

(54) NEXT GENERATION INTERCONNECT

(75) Inventor: Rene Augusto Mosquera, Laguna Niguel, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/439,127

(22) Filed: Nov. 12, 1999

(51) Int. Cl.[7] ..... H01R 17/00

(52) U.S. Cl. ..... 439/660; 439/65; 439/66; 439/500

(58) Field of Search ..... 439/660, 65, 66, 439/500, 862, 746, 747, 260, 79, 62

(56) References Cited

U.S. PATENT DOCUMENTS

| | | | |
|---|---|---|---|
| 3,169,042 | 2/1965 | Jepson | 339/91 |
| 3,209,308 | 9/1965 | Aquillon | 339/176 |
| 5,213,513 | 5/1993 | Brown et al. | 439/68 |
| 5,242,314 | 9/1993 | Di Giulio et al. | 439/404 |
| 5,259,769 | 11/1993 | Cruise et al. | 439/65 |
| 5,403,206 | 4/1995 | McNamara et al. | 439/608 |
| 5,484,310 | 1/1996 | McNamara et al. | 439/608 |
| 5,551,883 | 9/1996 | Davis | 439/65 |
| 5,607,326 | 3/1997 | McNamara et al. | 439/608 |
| 5,655,913 | 8/1997 | Castaneda et al. | 439/66 |
| 5,716,230 | 2/1998 | Marren et al. | 439/500 |
| 5,746,626 | 5/1998 | Kwiat et al. | 439/630 |
| 5,772,449 | 6/1998 | Feldmeier et al. | 439/66 |

*Primary Examiner*—Gary F. Paumen
*Assistant Examiner*—Alexander Gilman
(74) *Attorney, Agent, or Firm*—Roger C. Turner

(57) ABSTRACT

First and second mateable connectors (12,14) each has a row of very closely spaced contacts mounted in a corresponding insulative frame. Each contact (80) of the first connector includes a piece of sheet metal with a strip portion (84) bent into a loop (86), with the loop projecting forward of the front end (100) of the first connector insulator (96). Each contact (82) of the second connector has a mating end (32) in the form of a vertically-elongated plate that compresses the loop when the connectors mate. Each first contact includes a flat plate portion (90) lying in a vertical plane and in interference fit with the walls of a passage (94) in the first insulator. The first contact also includes a 90° bend (92) that connects the strip portion (84) to the plate portion at the rear of the first insulator.

12 Claims, 4 Drawing Sheets

NEXT GENERATION INTERCONNECT

CROSS-REFERENCE TO RELATED APPLICATION

This application is related to U.S. patent application Ser. No. 09/439125 (now is U.S. Pat. No. 6,146,180) filed concurrently on Nov. 12, 1999.

BACKGROUND OF THE INVENTION

Cell phones are becoming progressively smaller in size while functions and versatility are increased. This requires additional lines and corresponding contacts for data and power, and a small pitch to fit them all into a very small cell phone. One recent cell phone requires contacts at a pitch of 0.8 mm (0.0315 inch). A new approach is required in order to provide contacts of very small width so they can be spaced at a pitch such as 0.8 mm or less. One application is where such a connector is built into a cell phone, for mating with a corresponding cradle on a car kit, where the contacts must be constructed for a low mating force, narrow geometry to fit into a 0.8 mm pitch, and high durability.

SUMMARY OF THE INVENTION

In accordance with one embodiment of the present invention, connectors with unusual contacts are provided, that enable the contacts to be very closely spaced along a row of contacts. A first connector includes an insulator with a row of passages and a plurality of signal contacts that are each mounted in one of the passages, with each contact having a front mating end. The contact front mating end comprises a loop that projects forward of the insulator front mating end. Second contacts of the second connector have mating ends in the form of vertically-elongated plates that face generally rearwardly and that compress the projecting loop at the mating end of a first contact when the connectors are mated.

Each passage of the first connector insulator is of generally rectangular cross-section, with a height that is a plurality of times as great as the width. Each first contact includes a plate portion that extends along the height of the passage, in interference with the passage, and a 90° bend at the top of the plate that connects the strip-shaped portion of the first contact to the plate.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
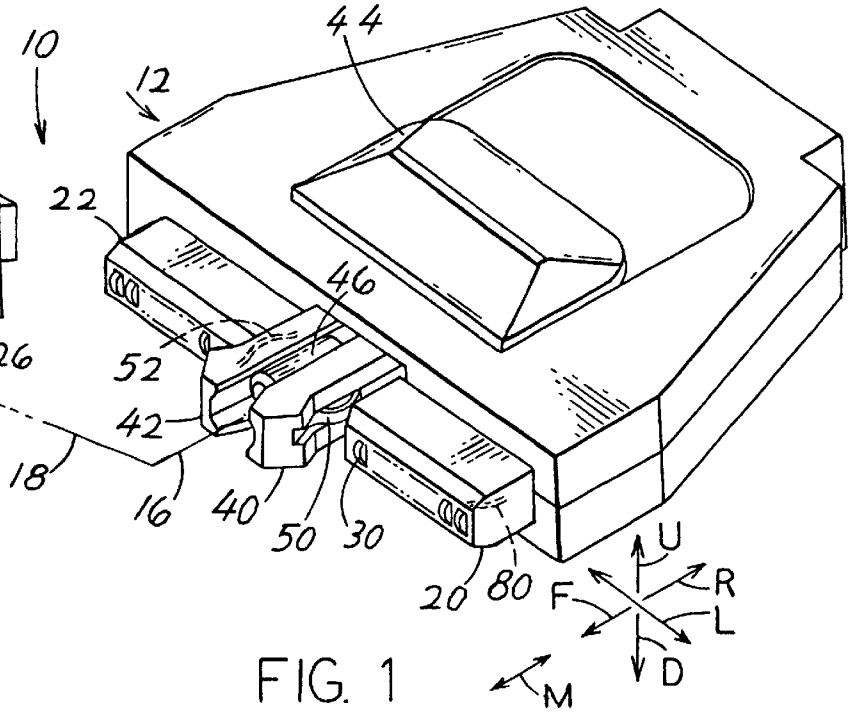
FIG. 1 is an exploded isometric view of first and second connectors of the present invention.
Figure 2:
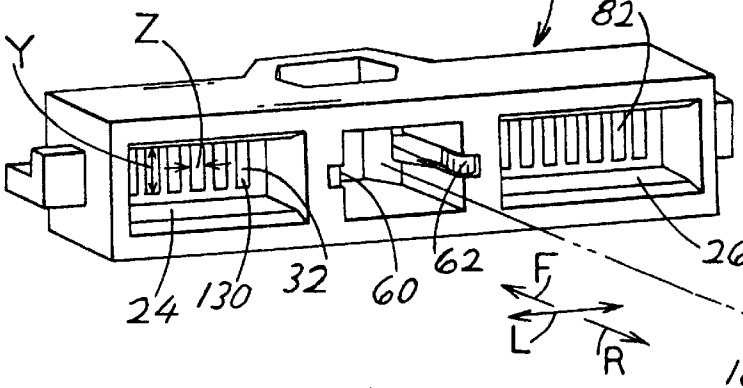
FIG. 2 is an exploded view of the parts of the first connector of the combination of FIG. 1.
Figure 2:
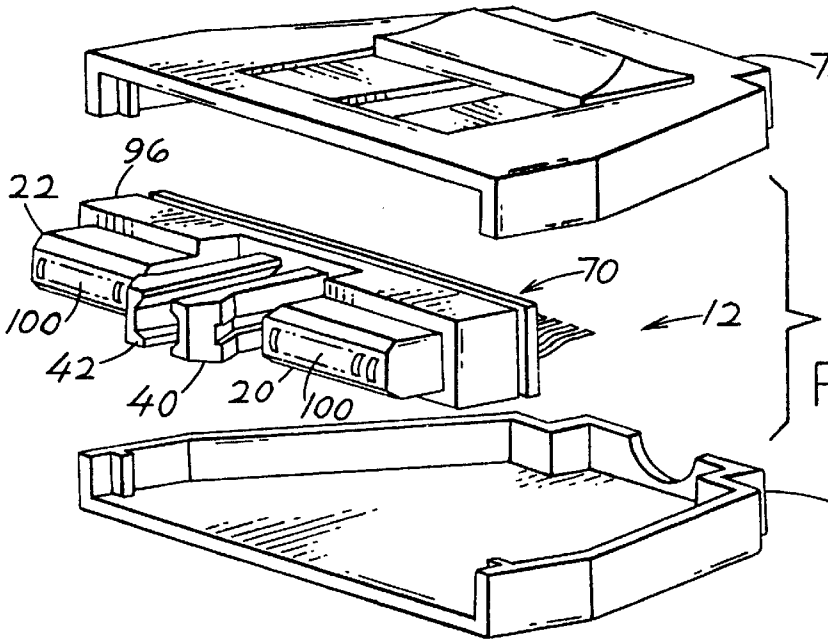
Figure 3:
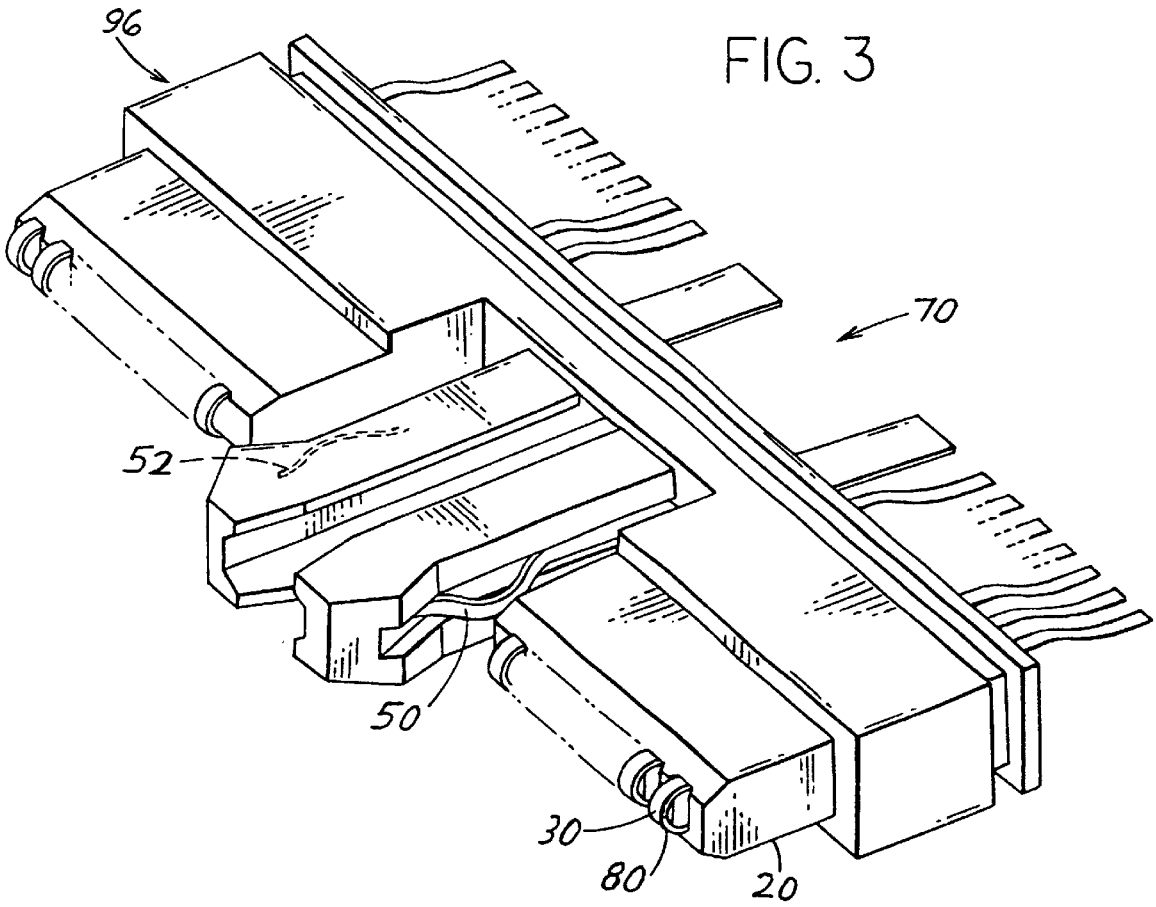
FIG. 3 is an enlarged view of the plug assembly of the connector of FIG. 2.

FIG. 1 illustrates a connector system or combination 10 which includes a first connector 12 and a connector device or second connector 14 that can be mated by moving each connector towards the other along their corresponding axes 16, 18. Both axes extend in front and rear F, R longitudinal directions M. The first connector 12 is a plug connector with a pair of plug parts 20, 22 that can be inserted into corresponding cavities 24, 26 of the second connector. Each plug part such as 20 has a row of signal contacts 80 with mating ends 30 that engage corresponding contact mating ends 32 of the second connector. The particular connectors include latch arms 40, 42 that can lock the connectors together when they have been mated. That is, when the connectors have been mated, a handle 44 is moved forward to move a post 46 forward to lock the connectors together. This type of mechanism is described in U.S. Pat. Nos. 5,387,110 and 5,411,402. It is noted that the first connector has a pair of power contacts 50, 52 that mate with corresponding power contacts 60, 62 of the second connector when the connectors mate. FIG. 2 shows that the first connector 12 includes a plug assembly 70 that forms the two plug parts 20, 22, and a cover that includes top and bottom cover parts 72, 74. The plug assembly 70 includes an insulator 96 that has front surfaces at 100 at the plug parts, with the latch arms projecting forward of the plug part front surfaces.

Figure 4:
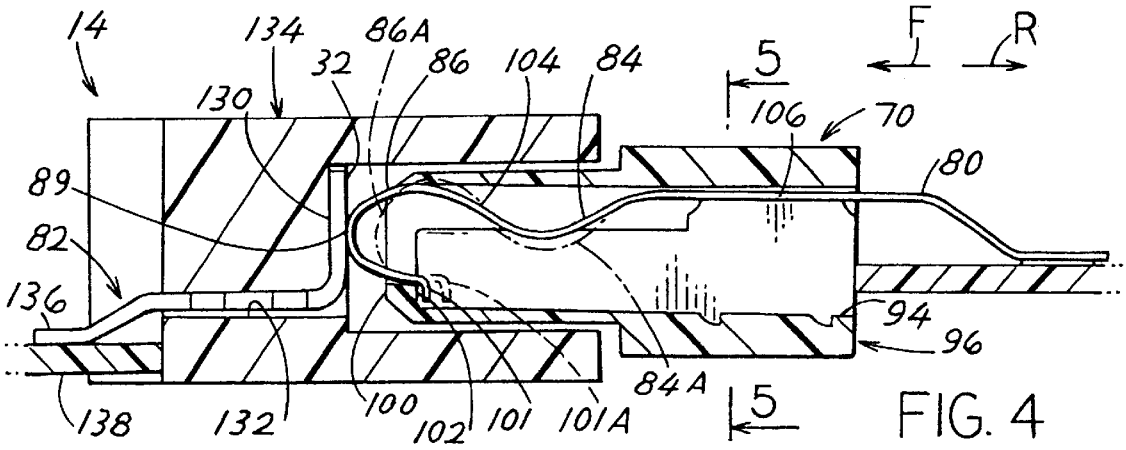
FIG. 4 is a sectional view of the connectors of FIG. 1, showing them just prior to full mating of the connectors.
Figure 6:
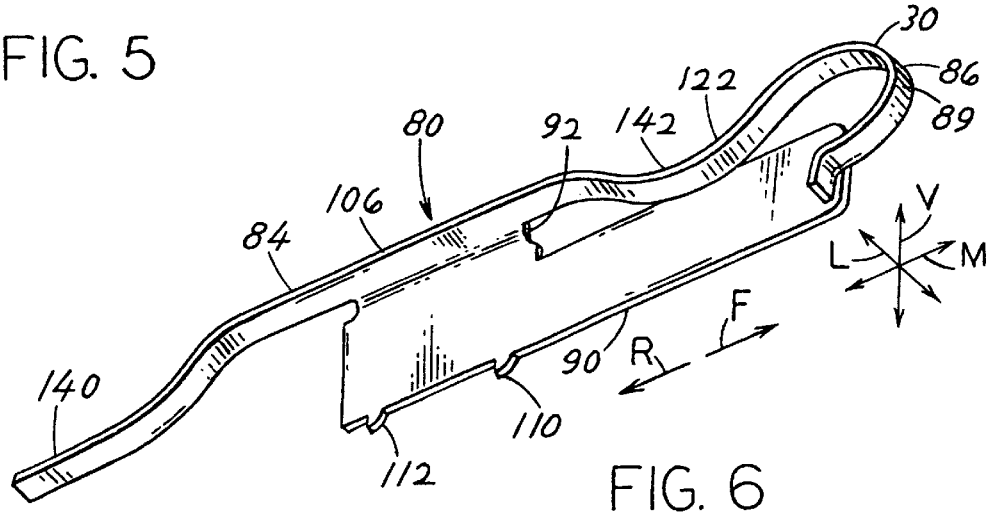
FIG. 6 is a bottom and front isometric view of a contact of the first connector of FIG. 4.
Figure 11:
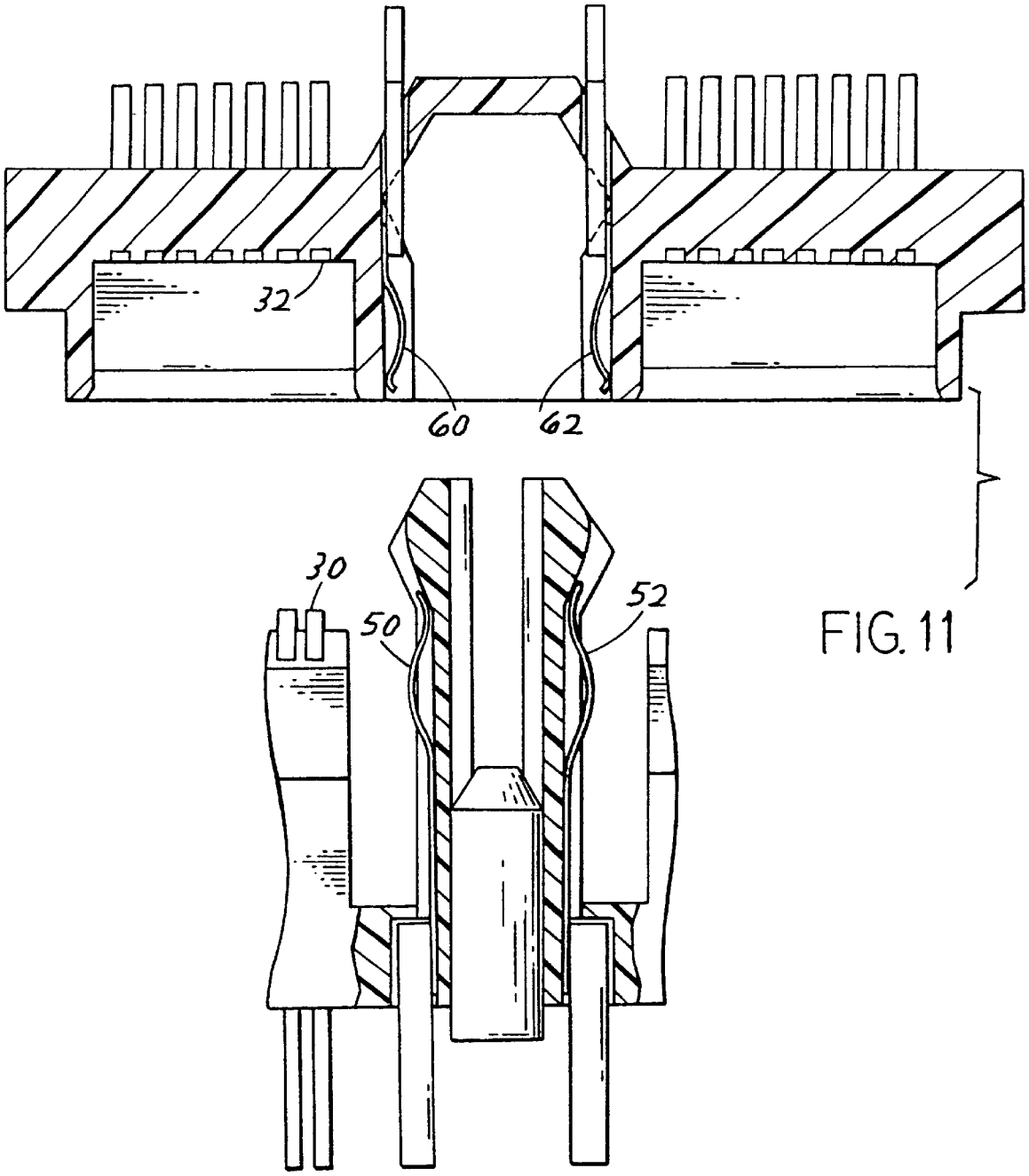
FIG. 11 is an exploded sectional view of the second connector of FIG. 1 and a portion of the first connector of FIG. 1.

FIG. 4 shows the general shape of each first contact 80 of the plug assembly of the first connector, and of each second contact 82 of the second connector 14. The first contact 80 has a construction such as shown in FIG. 6, in that it includes a strip portion 84 with a front mating end 30 in the form of a loop 86. The loop has a loop middle with a frontmost end at 89 that faces forwardly. The contact also includes a flat plate portion 90 that is connected to the strip portion at a right angle bend 92. FIG. 4 shows that the contact 80 is mounted in a passage 94 of an insulator 96. The insulator has a local front end 100 at the plug parts, and the loop 86 projects forward of the insulator front end. The lower end of the loop forms a tab 101 that normally abuts a rearwardly-facing shoulder 102 on the insulator. When the contact is fully mated, with the loop being deflected to the position 86A, the tab is deflected rearwardly to the position 101A. There is also some column-type collapse of an upper front part 104 of the strip portion 84 of the contact, as to 84A. A connected strip portion 106 that connects to the plate, does not bend.

Figure 5:
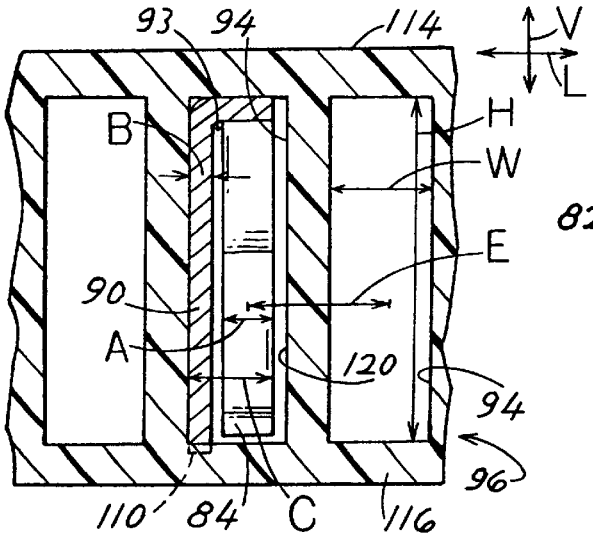
FIG. 5 is a view taken on line 5—5 of FIG. 4.

FIG. 5 shows that each first passage 94 of the first connector has a height H in a vertical direction V that is a plurality of times (at least twice) as great as its width W in a lateral direction L. The plate portion 90 of each contact has a height that is preferably slightly greater than the height H of the passage, to lie in an interference fit with the passage. FIG. 6 shows that the plate portion has a pair of barbs 110, 112 that are provided to dig into one of the walls 114, 116 such as the bottom wall, of the insulator passage to fix the plate portion in place, and therefore the entire contact in place in the insulator. FIG. 5 shows that bent parts of the strip portion 84 extend the strip portion downwardly from the right angle bend, so the strip part lie at about the same height as the plate portion 90. The strip portion 84 is slightly spaced from both the plate portion 90 and from a side wall 120 of the passage, to allow a front part 122 (FIG. 6) of the contact that lies forward of the bend 92, to freely deflect. The bent portion 92 is bent about a longitudinal axis 93 (FIG. 5). It is noted that the barbs 110, 112 preferably have flat surfaces facing rearwardly, to allow the contact to be forced forwardly into a passage, with the barbs then resisting rearward movement out of the passage.

The second contact 82 shown in FIG. 4, has a vertically-elongated plate at 130 which forms a primarily rearwardly-facing face at the mating end 32 of the second contact. The face at 32 is preferably substantially flat to make line contact at the loop middle 89, although such reliable contact can be achieved with slight curvature of the plate at 130. Each second contact lies in a second bore or passage 132 of a second connector insulator 134 and has a tail 136 that can be soldered to a trace on a circuit board 138. As shown in FIG. 1, each plate 130 has a vertical height Y that is a plurality of times as great as its lateral width Z in order to assure contact with the projecting loop of a contact of the first connector.

FIG. 6 shows that each first contact 80 is formed from a single piece of sheet metal that has been cut to the appropriate shape, with front and rear parts 122, 140 of the strip portion deformed to the shapes shown, and with the approximately 90° bend 92 that places the plate portion 90 in a vertical plane while the strip portion 84 extends perpendicular to the plate portion in horizontal planes. The bend at 92 is at the rear portion of the contact part that lies within the insulator, for a maximum length of front part 122 of the strip portion that is free to bend up and down. A downward deformation at 142 in the front part 122 makes the front part more easily collapsed in column collapse when the loop 86 is rearwardly deflected during mating. The rear part 140 is shown constructed to lie against a trace on a circuit board to which the rear portion is soldered.

Figure 10:
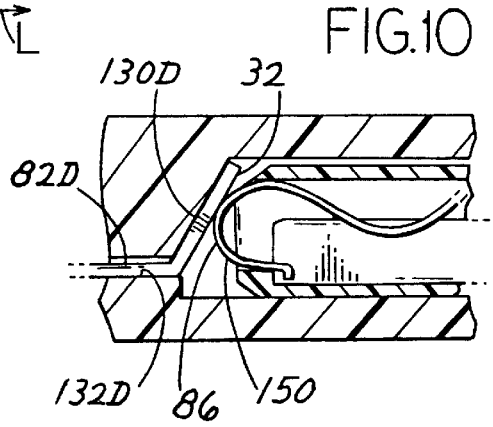
FIG. 10 is a partial view showing a connector combination of a modified embodiment of the invention.

FIG. 10 shows the plate 130D of another embodiment of the invention, where the rearwardly-facing front 32 of the plate is angled to face rearwardly and at a downward incline. This can help to bend the free bottom 150 of the loop more than the top of the loop. The plate 130D, like the plate 130 in FIG. 4, extends primarily perpendicular, or normal, to the bore 132D.

Figure 7:
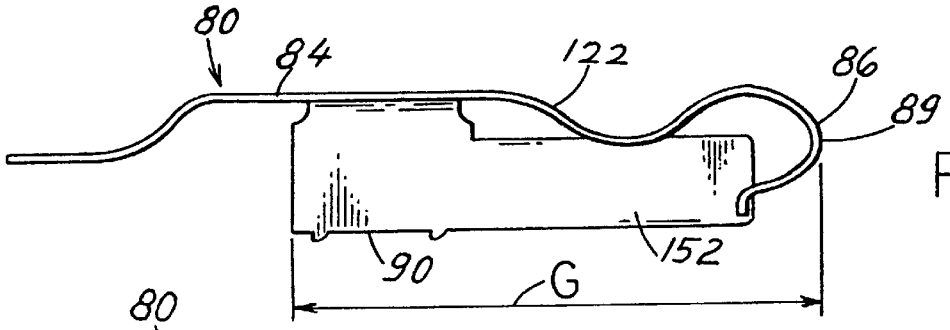
FIG. 7 is a first side elevation view of the contact of FIG. 6.
Figure 8:
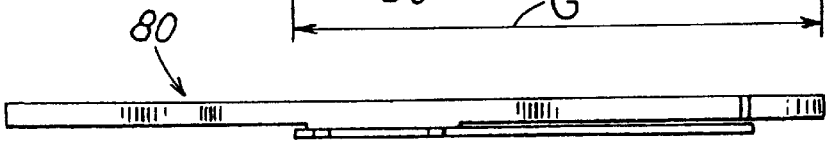
FIG. 8 is a plan view of the contact of FIG. 6.
Figure 9:
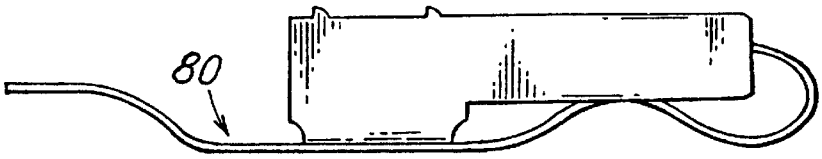
FIG. 9 is a second side elevation view of the contact of FIG. 6.

In a connector system that applicant has designed, each contact was constructed of sheet metal having a thickness B (FIG. 5) of 0.14 mm (0.0055 inch). Each strip portion 84 had a width A of 0.313 mm (0.0123 inch). The overall width C of the contact was 0.5 mm and the passages were spaced apart by a distance E of 0.8 mm. Each passage had a height H of 1.85 mm (0.0728 inch) and a width W of about 0.6 mm (0.015 inch). Each contact had a length G (FIG. 7) between the rear of its plate portion and the front of the loop 86, of 6.5 mm (0.2559 inch). It is noted that the plate portion 90 has a front plate part 152 of reduced height, which extends along more than half the plate length in a longitudinal direction M. The part 152 helps to limit sideward deflection of the front part 122 of the strip portion. The thickness of the strip portion 84 is preferably the same as that of the plate portion 90, although one of them can be thinned up to half of the other, although the thickness are then still substantially the same.

While terms such as "vertical", "upper", etc. are used to help in explaining the invention as illustrated, the connectors can be used in any orientation with respect to the Earth.

Thus, the invention provides a connector system which enables the use of very closely spaced contacts. A first connector includes an insulator having passages with contacts therein having front mating ends that project in a loop forwardly out of the passage, with the loop designed to be primarily rearwardly compressed by abutment against a plate-like rear end of a mating contact of a second connector. The first contacts of the first connector include plate portions that lie in an interference fit with top and bottom passage walls, and a strip portion connected to the top of the plate portion by an approximately 90° bend.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector comprising:

an insulator having a plurality of parallel passages and an insulator front mating end;

a plurality of contacts that are each mounted in one of said passages, with each contact having a contact front mating end;

each contact front mating end comprises a loop that projections forward of said insulator front mating end, with said loop having a loop middle that faces forwardly and which is the frontmost part of the contact;

each of said passages is of rectangular cross-section, with a width and with a height that is a plurality of times as great as said width;

each of said contacts includes a plate portion that extends along substantially the entire the height of one of said passages and that has upper and lower vertically spaced plate ends, and a strip portion that is connected to said plate portion in a right angle bend at one of said vertical plate ends, with said strip portion having a strip width that is greater than said strip thickness, with said strip width extending parallel to the width of said passage, and with said strip portion forming said loop that projects forward of said insulator front portion.

2. The connector described in claim 1 including:

a second connector device which has an insulator with a plurality of bores, and which has a plurality of contact elements each lying in one of said bores, with each contact element having a mating end in the form of a plate that extends primarily normal to said bores.

3. A contact comprising:

a piece of sheet metal that includes a plate portion and a strip portion, said plate portion being substantially flat and having a predetermined thickness in a lateral direction, a height in a vertical direction, and a length in a longitudinal direction that is perpendicular to said lateral and vertical directions, with said height and length each being a plurality of times greater than said thickness;

said strip portion having substantially said predetermined thickness in said vertical direction and having a width in said lateral direction which is greater than said predetermined thickness, with said strip portion having longitudinally-spaced front and rear end parts and having a front end;

said piece of sheet metal having a right angle bent portion which is bent about a longitudinally-extending axis, with said bent portion being elongated in said longitudinal direction, said plate portion and said strip portion lying on opposite sides of said bent portion and merging therein with said bent portion having a front end lying a distance rearward of said front end of said strip portion to allow said front end of said strip portion to easily bend;

said strip portion having bent parts lying below said right angle bent portion, and at least part of said plate portion extending downwardly from said bent portion to lie at about the same height as said bent parts of said strip portion.

4. The contact described in claim 3 wherein:

said front end of said strip portion is bent into a loop with top and bottom ends and with a loop middle that is the most forward part of said contact.

5. The connector described in claim 3, including a connector, and wherein:

said connector has an insulator with a plurality of passages extending in front and rear directions, with said insulator having a local front end lying adjacent to front ends of said passages, with said contact lying in one of said passages and with said middle of said loop lying forward of said local front end of said insulator;

each of said passage front ends has a height, and said loop has top and bottom ends each lying in said passage and vertically spaced by more than half the height of said passage front end.

6. The contact described in claim 3 including a connector, wherein:

said connector has an insulator with a plurality of parallel passages and said contact lies in a first of said passages, with said first passage having top and bottom walls spaced by a height substantially equal to the height of said plate portion with said plate portion lying in interference fit with said top and bottom walls, and with said front end part of said strip portion being free to deflect up and down.

7. The combination of first and second connectors, wherein:

said second connector has a second insulator with a rear end forming a rearwardly opening cavity, said second insulator having a plurality of parallel second passages each extending in a forward longitudinal direction from a front end of said cavity, and said second connector has a plurality of second contacts that each extends through one of said second passages and that has a front termination end and that has a rear mating end with a surface that faces primarily rearwardly and that lies in said cavity;

said first connector has a first insulator with a front end that can fit in said cavity, said first connector having a plurality of parallel first passages each extending in a longitudinal direction, and has a plurality of first contacts that each extends through one of said first passages, with each first contact having a front end forming a loop that has upper and lower ends each lying in a passage in said first insulator and a loop middle that is positioned to be pushed rearwardly by a surface of one of said second contacts as said first insulator front end moves into said cavity.

8. The combination described in claim 7 wherein:

each of said passage has a front end and the loop at each contact extends in a single substantially 180° bend across substantially the entire height of the passage front end, with the upper and lower ends of each loop lying in the passage.

9. The combination described in claim 7 wherein:

each of said first passages has a vertical height and a lateral width;

each of said first contacts includes a plate portion that extends along substantially the entire height of one of said passages and that has upper and lower vertical plate ends, a strip portion and a right angle bend that connects said strip portion to said plate portion at one of said vertical plate ends, with said strip portion having a strip thickness and having a strip width that is greater than said strip thickness, with said strip width extending in a lateral direction that is normal to said plate portion, and with said strip portion forming said loop.

10. The combination described in claim 9, wherein:

each of said first passages is of substantially rectangular shape with a laterally-extending width and with top and bottom walls spaced by a height that is a plurality of times as great as said width;

said plate has top and bottom plate surfaces that lie in interference fit with said top and bottom walls of said passage.

11. A connector comprising:

an insulator having a plurality of parallel passages and an insulator front mating end, with each passage having a front end with vertically spaced opposite sides;

a plurality of contacts that are each mounted in one of said passages, with each contact having a contact front mating end;

each contact front mating end comprises a single loop that projects forward out of said passage front end and forward of said insulator front mating end, with said loop having a loop middle that faces forwardly and which is the frontmost part of the contact, and with each loop having vertically spaced opposite loop sides;

each of said loop opposite sides lies in a single one of said passages, with said loop opposite sides having locations that are vertically spaced apart by more than half the vertical height of said passage front end with said loop opposite sides biased against opposite sides of said passage, with said insulator forming a partially rearwardly-facing shoulder at one side of said insulator front mating end and with said loop having a loop side that lies against said shoulder.

12. The connector described in claim 11, wherein:

each of said passages is of rectangular cross-section, with a width and with a height that is a plurality of times as great as said width;

each of said contacts includes a plate portion that extends along the height of one of said passages and that has upper and lower vertically spaced plate ends that respectively engage upper and lower walls of said passage, and a strip portion that is connected to said plate portion in a right angle bend at one of said vertical plate ends, with said strip portion having a strip width that is greater than said strip thickness, with said strip width extending parallel to the width of said passage, and with said strip portion forming said loop that projects forward of said insulator front portion.

* * * * *